US009304450B2

(12) United States Patent
Matsuura

(10) Patent No.: US 9,304,450 B2
(45) Date of Patent: Apr. 5, 2016

(54) IMAGE FORMING APPARATUS FOR CORRECTING A SET VOLTAGE TO BE APPLIED DURING AN IMAGE FORMATION OPERATION

(71) Applicant: CANON KABUSHIKI KAISHA, Tokyo (JP)

(72) Inventor: Taisuke Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/461,080

(22) Filed: Aug. 15, 2014

(65) Prior Publication Data

US 2015/0050037 A1 Feb. 19, 2015

(30) Foreign Application Priority Data

Aug. 19, 2013 (JP) ..... 2013-169746

(51) Int. Cl.
*G03G 15/00* (2006.01)
*G03G 15/16* (2006.01)

(52) U.S. Cl.
CPC ..... *G03G 15/1675* (2013.01)

(58) Field of Classification Search
CPC ..... G03G 15/50; G03G 21/20; G03G 2215/0634; G03G 2215/16; G03G 15/1675
See application file for complete search history.

(56) References Cited

U.S. PATENT DOCUMENTS

2008/0285993 A1* 11/2008 Ishida ..... G03G 15/0283 399/58
2011/0069979 A1* 3/2011 Yamada ..... G03G 15/1605 399/44
2012/0003016 A1* 1/2012 Uchiyama et al. ..... 399/301
2012/0099880 A1* 4/2012 Inoue ..... G03G 15/1645 399/66
2013/0058669 A1* 3/2013 Okada ..... G03G 15/5058 399/49
2013/0330096 A1* 12/2013 Mochizuki ..... 399/66

FOREIGN PATENT DOCUMENTS

JP 2-123385 A 5/1990
JP 5-181373 A 7/1993
JP 10-207262 A 8/1998
JP 2012-088553 A 5/2012

* cited by examiner

*Primary Examiner* — Francis Gray
(74) *Attorney, Agent, or Firm* — Canon U.S.A., Inc. IP Division

(57) ABSTRACT

An information forming apparatus includes an execution unit configured to execute a setting mode which sets a voltage to be applied to the transfer member during an image formation operation and a correction mode which corrects the voltage set by the setting mode and a storage unit configured to store in advance a correction current difference based on the environment that is a difference between a current when a predetermined voltage is applied to the transfer member during the first period and a current when a predetermined voltage is applied to the transfer member during the second period. The execution unit corrects the voltage set by the setting mode in accordance with the correction current difference based on a detection result from the first detection member and a detection result from the second detection member in a case that the correction mode is executed during the first period.

10 Claims, 9 Drawing Sheets

IMAGE FORMING APPARATUS FOR CORRECTING A SET VOLTAGE TO BE APPLIED DURING AN IMAGE FORMATION OPERATION

BACKGROUND OF THE INVENTION

1. Field of the Invention

The present invention relates to image forming apparatuses which form images based on electrophotography or an electrostatic recording method.

2. Description of the Related Art

Conventionally, in an image forming apparatus based on electrophotography, for example, an electrophotography photosensitive member (photosensitive member) serving as an image-bearing member is electrostatically charged, and the electrostatically charged photosensitive member is exposed in accordance with image information to form an electrostatic image. The electrostatic image is developed with toner and is then transferred to a member to be transferred to form an image. A widely used member for transferring a toner image from a photosensitive member to a member to be transferred may be a transfer roller which is abutted with the photosensitive member directly or through the member to be transferred with application of a transfer bias.

In order to suppress occurrence of defective transfer arising from variations in electric resistance of a transfer member, control methods including determination of transfer biases have been proposed such as an ATVC control and a PTVC control method as disclosed in Japanese Patent Laid-Open Nos. 2-123385 and 5-181373. These methods may include, before execution of image formation, applying voltage to a transfer unit, measuring a value (transfer current value) of current fed to the transfer unit, and setting a voltage condition for use in the transfer unit for image formation. In other words, a transfer bias to be applied to a transfer member for image formation is controlled based on a result of measurement of information regarding an electric resistance of the transfer member before the image formation is performed.

Here, such control including determination of a transfer bias is executed in a down time (or a period when image output is disabled for performing an adjusting operation, for example) during a pre-multi-rotation period, a pre-rotation period or an interval between sheets. Based on the current information regarding electric resistance of the transfer member, a voltage value (transfer voltage value) of the transfer bias for image formation is determined. The transfer voltage value determined properly at a certain time point may not be proper gradually due to changes in ambient temperature of a main body of the image forming apparatus, changes in temperature of the transfer member, or an increase of the electric resistance value caused by energization of the transfer member, for example. It may be considered to execute an ATVC control or a PTVC control frequently or to increase the frequency of execution of control including determination of the transfer bias. For example, when a condition for a change of the electric resistance value of the transfer member is satisfied such as a case where the environment (such as temperature and humidity) in which the image forming apparatus is provided or where a predetermined number of image formed sheets are acquired, an ATVC control or a PTVC control may be executed. More specifically, it may be executed frequently during a pre-multi-rotation period or a pre-rotation period or it may be executed during a time period set in an interval between sheets by interrupting a continuous printing operation, which is then performed after the execution of control.

Such an increased frequency of execution of control including determination of a transfer bias may allow application of a transfer bias based on a current electric resistance value of a transfer member even when the electric resistance value of the transfer member changes. However, the down time may be increased as a result, which may have an influence on productivity.

Accordingly, Japanese Patent Laid-Open No. 10-207262 discloses a correction control for performing a simpler control to correct a transfer voltage value determined once by an ATVC control or a PTVC control. According to the correction control, in a case where a transfer current value detected after applying a transfer bias for a transfer voltage value determined once by an ATVC control or a PTVC control is not matched with a target current value, the transfer voltage value is corrected so as to obtain the transfer current value close to the target current value. In other words, a difference current value (current difference) between the transfer current value to be detected and the target current value is calculated, and a voltage value corresponding to the current difference is added or subtracted to or from the transfer voltage value determined by an ATVC control or a PTVC control. Such a correction control may be performed in a timing such as during a pre-rotation period or an interval between sheets in a continuous printing operation but is simpler than the control including determination of a transfer bias by performing an ATVC control or a PTVC control. Thus, the influence on productivity may be reduced as much as possible.

By the way, a transfer current value detected in such a correction control as described above may depend on the presence of toner, called fogging toner, on a surface of a photosensitive member, attached to a non-image part. Fogging toner may easily occur on a surface of a photosensitive member in a case where a developer carrier in a developing unit is driven and a developing AC bias (AC voltage component of a developing bias) is applied to the developer carrier. Normally, the transfer current value may differ between a state with application of a developing AC bias and a state without it even when an equal transfer bias is applied to a transfer voltage value. More specifically, when a predetermined transfer bias for a transfer voltage value is applied and the developing AC bias is changed from an OFF state to an ON state, the transfer current value decreases since a region of a photosensitive member having been in a developing portion reaches a transfer portion at the ON state.

FIG. 9 illustrates changes of the transfer current value based on ON/OFF states of the developing AC bias. As illustrated in FIG. 9, the developing AC bias is normally turned to an ON state in a timing immediately before an image area during a pre-rotation period. This is for the reasons below. That is, when a developer carrier is driven and the developing AC bias is turned on, the deterioration of the developer may normally advance thereby. The deterioration of a developer may desirably be suppressed by stopping a driving developer carrier and turning off a developing AC bias during a period where image formation is not performed.

An ATVC control or PTVC control as described above acquires a transfer voltage value corresponding to a target current value for image formation. For that, a transfer current value is desirably detected with a developing AC bias applied as in image formation. Accordingly, the ATVC control or PTVC control is normally performed with application of a developing AC bias. Also, the correction control is desirably performed with application of a developing AC bias for correction based on a result of detection of a transfer current value under a condition corresponding to an actual image formation.

However, a developing AC bias may not always be applied when a transfer current value is detected in the correction control. In this case, because no fogging toner exists, the detected transfer current value may be higher than that in a normal image formation with a developing AC bias applied.

Such a difference of the transfer current value detected in the correction control due to the presence or absence of fogging toner depending on the presence or absence of a developing AC bias as described above may be corrected by the following method. That is, a difference value of the transfer current value detected in the correction control assumed based on the presence or absence of a developing AC bias is defined as a predetermined set value. The set value is subtracted from the transfer current value detected without a developing AC bias applied in the correction control. The thus acquired value may be used for correcting the transfer voltage value as a value corresponding to the transfer current value with a developing AC bias applied.

However, such a difference value of a transfer current value depending on the presence or absence of a developing AC bias may largely depend on the amount of fogging toner. The amount of fogging toner may largely depend on an environment in which the image forming apparatus is provided or the level of deterioration of a developer due to repetitive executions of image formation (tolerance), for example. Generally, the amount of fogging toner is proportional to the charge amount of toner, and the amount of fogging toner increases under a high humidity/temperature with a lower charge amount or after deterioration of a developer due to repetitive executions of image formation.

Using one set value as a difference value of a transfer current value depending on the presence or absence of a developing AC bias for an amount of fogging toner largely depending on the condition may not result in proper transfer voltage value after the correction under some conditions. Thus, the transfer current value may be different from a target current and may possibly cause a defect image due to a defective transfer.

SUMMARY OF THE INVENTION

An image forming apparatus according to the present invention includes a movable image-bearing member, an electrostatic image forming unit configured to form an electrostatic image on the image-bearing member, a developing unit configured to develop an electrostatic image formed on the image-bearing member into a toner image in a developing portion, a developing bias power supply configured to apply a developing bias to the developing unit, a transfer member configured to transfer the toner image from the image-bearing member onto a member to be transferred in a transfer portion, a transfer power supply configured to apply voltage to the transfer member, a first detection member configured to detect a current to the transfer member, a second detection member configured to detect an environment relating to a temperature and a humidity around the image forming apparatus, an execution unit configured to execute a setting mode to be executed during a non-image-formation period, the setting mode setting a voltage to be applied to the transfer member during an image formation operation based on a voltage to be applied to the transfer member and a detection result from the first detection member, and a correction mode to be executed in a non-image-formation period excluding a period for executing the setting mode, the correction mode correcting the voltage set by the setting mode based on a difference between a detection result from the first detection member regarding a test voltage applied to the transfer member and a predetermined target current value, wherein a period for executing the correction mode is shorter than a period for executing the setting mode, and wherein the correction mode is executed in one of a first period when a region of the image-bearing member having been in the developing portion when the developing bias power supply has an off state passes through the transfer portion next and a second period when the region of the image-bearing member having been in the developing portion when the developing bias power supply has an on state passes through the transfer portion, and a storage unit configured to store in advance a correction current difference based on the environment that is a difference between a current when a predetermined voltage is applied to the transfer member during the first period and a current when a predetermined voltage is applied to the transfer member during the second period. In this case, the execution unit corrects the voltage set by the setting mode in accordance with the correction current difference based on a detection result from the first detection member and a detection result from the second detection member in a case that the correction mode is executed during the first period.

Further features of the present invention will become apparent from the following description of exemplary embodiments with reference to the attached drawings.

DESCRIPTION OF THE EMBODIMENTS

An image forming apparatus according to the present invention will be described further in detail with reference to drawings.

First Exemplary Embodiment

1. Overall Constitution and Operations of Image Forming Apparatus

Figure 1:
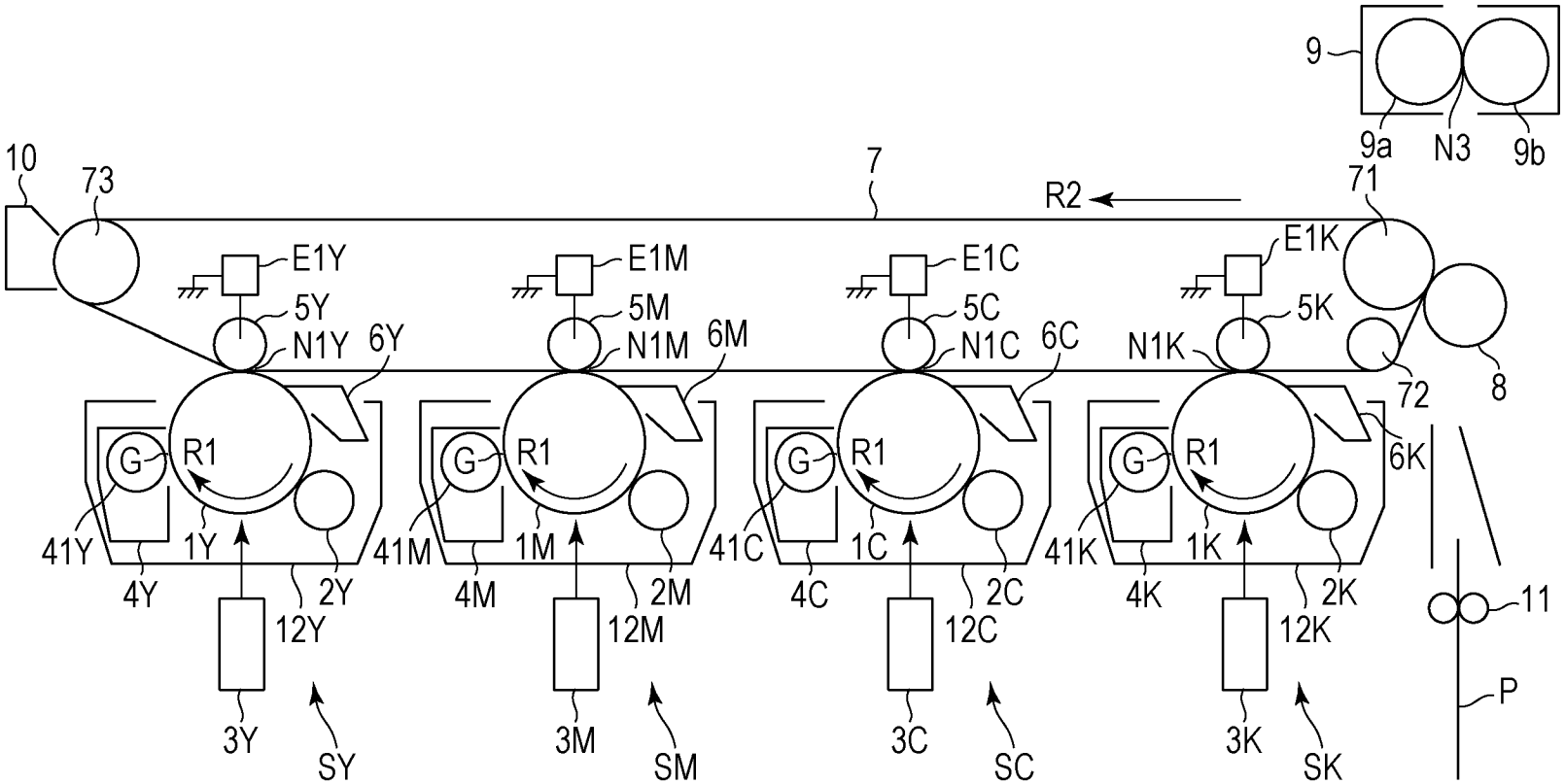
FIG. 1 is a schematic cross section view illustrating a schematic constitution of an image forming apparatus.

FIG. 1 is a schematic cross section view illustrating a schematic constitution of an image forming apparatus 100 according to a first exemplary embodiment. The image forming apparatus 100 of this exemplary embodiment is a tandem printer applying an intermediate transfer system capable of forming a full-color image based on electrophotography.

The image forming apparatus 100 has four image formation part S (stations) SY, SM, SC, and SK aligned in one line during a predetermined interval. The image formation part SY, SM, SC, and SK form images of colors yellow (Y), magenta (M), cyan (C), and black (K), respectively.

According to this exemplary embodiment, the constitutions and operations of the image formation part SY, SM, SC, and SK are substantially similar except for differences of colors of toners to be used therein. Therefore, if specific distinction is not required, attached characters Y, M, C, and K indicating elements of the respective image formation part S will be omitted, and the image formation part S will collectively be described.

The image formation part S has a photoconductive drum 1 that is a drum-type (cylindrical) electrophotography photosensitive member (photosensitive member) serving as a movable image-bearing member. The photoconductive drum 1 is rotationally driven in an R1 direction indicated by the illustrated arrow. The photoconductive drum 1 is surrounded by the following devices in order along the direction of rotation. First, a charging roller 2 that is a roller-shaped charging member is provided which serves as a charging unit. Next, an exposure device 3 serving as an exposure unit in an image formation unit is provided. Next, a developing device 4 is provided as a developing unit. Next, a primary transfer roller 5 that is a roller-shaped primary transfer member is provided which serves as a primary transfer member and transfers a toner image from an image-bearing member to a member to be transferred in a transfer portion. Next, a drum cleaning device 6 is provided as an image-bearing-member cleaning unit.

An intermediate transfer belt 7 is provided facing the photoconductive drums 1Y, 1M, 1C, and 1K of the image formation part SY, SM, SC, and SK. The intermediate transfer belt 7 may be a rotating endless belt serving as an intermediate transfer member that is an example of a member to be transferred. The intermediate transfer belt 7 is stretched with a predetermined amount of tensile force by a driving roller 71, an idol roller 72 and a tension roller 73 serving as a plurality of tension rollers (supporting rollers) and has its inner surface supported thereby. When the driving roller 71 is rotationally driven, the intermediate transfer belt 7 is thus rotationally driven in an R2 direction indicated by the illustrated arrow. The primary transfer roller 5 is provided at a position facing the corresponding photoconductive drum 1 on an inner circumferential surface of the intermediate transfer belt 7. The primary transfer rollers 5 is pressed against the corresponding photoconductive drum 1 through the intermediate transfer belt 7, which forms a primary transfer portion (primary transfer nip) N1 where the intermediate transfer belt 7 and the photoconductive drum 1 are in contact. A secondary transfer roller 8 that is a roller-shaped secondary transfer member serving as a secondary transfer member is provided at a position facing a driving roller (opposed roller) 71 on an outer circumferential surface of the intermediate transfer belt 7. The secondary transfer roller 8 is pressed against the driving roller 71 through the intermediate transfer belt 7, which forms a secondary transfer portion (secondary transfer nip) N2 where the intermediate transfer belt 7 and the secondary transfer roller 8 are in contact. A belt cleaning device 10 serving as an intermediate transfer member cleaning unit is provided at a position facing the tension roller 73 on the outer circumferential surface of the intermediate transfer belt 7.

Each of the image formation parts S includes a process cartridge 12 detachably attached to a main body of the image forming apparatus 100 integrally. The process cartridge 12 contains the photoconductive drum 1, the charging roller 2 serving as a processing unit that operates on the photoconductive drum 1, and the developing device 4 and the drum cleaning device 6.

During an image formation process, a surface of the rotationally driven photoconductive drum 1 is electrostatically charged substantially evenly by the charging roller 2. Next, the electrostatically charged surface of the photoconductive drum 1 is scanning exposed by the exposure device 3 in accordance with image information on the corresponding image formation part S. Thus, an electrostatic image (electrostatic latent image) is formed on the surface of the photoconductive drum 1. Next, the electrostatic image formed on the photoconductive drum 1 is developed as a toner image with toners of the colors corresponding to the image forming units S by the developing device 4.

Next, the toner image formed on the photoconductive drum 1 is transferred (primary transfer) to the intermediate transfer belt 7 being rotationally driven by action of the primary transfer roller 5 in the primary transfer portion N1. In this case, the primary transfer roller 5 is applied with a primary transfer bias that is a direct current voltage having the opposite polarity (positive polarity in this exemplary embodiment) of the electrostatically charge polarity of the toner used for the development from a primary transfer power supply E1 serving as a primary transfer power supply. For example, in order to form a full-color image, toner images of colors formed on the photoconductive drums 1 in the image forming units S are transferred (primary transfer) overlappingly on the intermediate transfer belt 7 sequentially in the primary transfer portions N1Y, N1M, N1C, and N1K. The toner image transferred to the intermediate transfer belt 7 is transferred (secondary transfer) to a recording medium P such as a recording sheet by action of the secondary transfer roller 8 in the secondary transfer portion N2. In this case, the secondary transfer roller 8 is applied with a secondary transfer bias that is a direct current voltage having the opposite polarity (positive polarity according to this exemplary embodiment) of an electrostatically charge polarity of the toner for development from a secondary transfer power supply, not illustrated. The recording medium P is fed by the recording medium feeding roller 11 and is conveyed to the secondary transfer portion N2 in synchronization with the toner image on the intermediate transfer belt 7.

The recording medium P having a toner image transferred thereon and being separated from the secondary transfer roller 8 is conveyed to a fixing device 9 serving as a fixing unit. The recording medium P is then pressed and heated in a fixing nip part N3 between a fixing roller 9*a* and a pressing roller 9*b* in the fixing device 9 so that the toner image is fixed thereon. After the toner image is fixed, the recording medium P is discharged externally to the main body of the image forming apparatus 100.

The toner (primary transfer residual toner) not being completely transferred to the intermediate transfer belt 7 and remaining on the photoconductive drum 1 in the primary transfer portion N1 is removed and collected from the photoconductive drum 1 by the drum cleaning device 6. The toner (secondary transfer residual toner) not being completely transferred to the recording medium P and remaining on the intermediate transfer belt 7 in the secondary transfer portion N2 is removed and collected from the intermediate transfer belt 7 by the belt cleaning device 10.

According to this exemplary embodiment, the photoconductive drum 1 has an organic photoconductor layer (OPC) having a negative polarity as its electrostatically charge polarity on an outer circumferential surface of an aluminum cylinder and has a diameter of 30 mm. The photoconductive drum 1 is rotationally driven in the R1 direction indicated by the illustrated arrow by a drum driving motor M1 (FIG. 2) serving as a photosensitive member driving unit.

According to this exemplary embodiment, the charging roller 2 is covered with a resistant elastic layer on its surface of a metallic rotation axis. The charging roller 2 is in pressure contact with the photoconductive drum 1 and rotates by following the rotation of the photoconductive drum 1. The charging roller 2 is applied with a charge bias having an alternating current voltage component over a direct current voltage component by an electrostatically charge power supply serving as a charge bias applying unit, not illustrated to electrostatically charge the surface of the photoconductive drum 1 to a substantially even potential having a negative polarity.

According to this exemplary embodiment, the exposure device 3 may be a laser scanner. The exposure device 3 may scan with a rotary mirror a laser beam having undergone ON-OFF modulation based on scanning line image data acquired by decompressing the color separation images corresponding to the image forming units S to write electrostatic images (electrostatic latent images) based on the image data on the electrostatically charged surface of the photoconductive drum 1.

According to this exemplary embodiment, the developing device 4 may be a two-component developing device applying a two-component development system using a two-component developer mainly containing nonmagnetic toner particles (toner) and magnetic carrier particles (carriers) as a developer. The developing device 4 stirs the two-component developer containing a mixture of toner and carrier to electrostatically charge the toner to a negative polarity and the carriers to a positive polarity. In other words, according to this exemplary embodiment, the electrostatically charge polarity (proper electrostatically charge polarity) of the toner to be used for a development process is a negative polarity. The electrostatically charged two-component developer is conveyed to a facing part (developing portion) G to the photoconductive drum 1 by a developing sleeve 41 serving as a rotatable developer carrier. The developing sleeve 41 is rotationally driven by the development driving motor M2 (FIG. 2) serving as a development driving unit. A development power supply E2 (FIG. 2) serving as a developing bias power supply applies a developing bias including an alternating-current voltage component (developing AC bias) over a direct-current voltage component (developing DC bias) having a negative polarity to the developing sleeve 41. Thus, the toner is moved to the exposure part of the photoconductive drum 1 having a positive polarity relatively with respect to the developing sleeve 41, and the electrostatic image undergoes reversal development. In other words, electrostatically charged toner having a same polarity as the electrostatically charge polarity of the photoconductive drum 1 is supplied to the exposure part on the surface of the photoconductive drum 1 having an absolute value of potential reduced as a result of exposure based on image information after uniform electrostatical charging thereon.

According to this exemplary embodiment, the primary transfer roller 5 has both ends in a longitudinal direction (rotational axial direction) urged by a spring member serving as an urging unit and is in pressure contact with the photoconductive drum 1 through the intermediate transfer belt 7.

The primary transfer roller 5 may be semi-conducting with an electric resistance value of $1\times10^2$ to $10^8\Omega$ occurring when 2000 V is applied. More specifically, according to this exemplary embodiment, the primary transfer roller 5 may be an ion electro conductive sponge roller having an outside diameter of 16 mm and an 8-mm diameter core metal formed by blending nitril rubber and an ethylene-epichlorohydrin copolymer. The electric resistance value of the primary transfer roller 5 may be about $1\times10^6$ to $10^8\Omega$ against applied voltage of 2 kV under an environment with a temperature of 23° C. and a humidity of 50% RH.

In this case, generally, the transfer roller serving as a transfer member may be a polyurethane foam roller or a nitril-butadiene rubber (NBR) foam roller containing an ionic substance. Alternatively, the transfer roller may be an ethylene-propylene-diene rubber (EPDM) foam roller in which electro conductive powder such as carbon black is distributed. For a roller containing carbon black as an electronically conductive material, unevenness of stable dispersiveness and electric resistance value are difficult to be adjusted, and it may sometimes be difficult to hold a stable electric resistance value within 1 digit in mass production. On the other hand, a roller containing an ion conductive material has a feature that a stable electric resistance value may be easily obtained. For that, an image forming apparatus in which a constant voltage is applied to a transfer unit to transfer a toner image to a member to be transferred, for example, a roller containing ion conductive foam sponge which is inexpensive and has an electric resistance that is easy to be adjusted is used as a transfer member. Such a roller may have an electro conductive elastic layer on an outer circumferential surface of an electro conductive core metal. On the other hand, an ion conductive material is easy to be evenly mixed with rubber but is hygroscopic. Therefore, the electro conductivity is influenced by an environment such as a temperature and a humidity, and the electric resistance value may largely change as a result. More specifically, under a low temperature and low pressure environment, the electric resistance value may sometimes be several hundred times. Continuous energization of a roller containing an ion conductive material may result in a bias of the ion conductive material, which increases its electric resistance value.

The cleaning device 6 uses a cleaning blade to perform frictional sliding on the surface of the photoconductive drum 1 and remove residual transfer toner adhered to the surface of the photoconductive drum 1 having passed through the primary transfer portion N1. The belt cleaning device 10 may have a similar constitution thereto.

According to this exemplary embodiment, the secondary transfer roller 8 has both ends in a longitudinal direction (rotational axial direction) urged by a spring member serving as an urging unit and is in pressure contact with the driving roller (opposed roller) 71 through the intermediate transfer belt 7. According to this exemplary embodiment, a pressure of 6.5 kgf is applied for the pressure contact. The driving roller (opposed roller) 71 is connected to a ground potential. According to this exemplary embodiment, the secondary transfer roller 8 may be an ion electro conductive sponge roller having an outside diameter of 18 mm and a 10-mm diameter core metal formed by blending nitril rubber and an ethylene-epichlorohydrin copolymer. The electric resistance value of the secondary transfer roller 8 may be about $1\times10^6$ to $10^8\Omega$ against applied voltage of 2 kV under an environment with a temperature of 23° C. and a humidity of 50% RH.

According to this exemplary embodiment, the intermediate transfer belt 7 may be a belt formed by a semi-conducting polyimide resin having a relative permittivity $\epsilon$=3 to 5 and a volume resistivity $\rho v=1\times10^6$ to $10^{11}$ Ωm. The driving roller 71 may have an elastic layer formed by a rubber material, and the elastic layer has a 0.5-mm thick semi-conducting rubber formed by distributing electro conductive carbon to an EPDM rubber. The electric resistance value of the driving roller 71 may be about $1\times10^1$ to $10^5\Omega$ against applied voltage of 10 V under an environment with a temperature of 23° C. and a humidity of 50% RH.

2. Control Configurations

Figure 2:
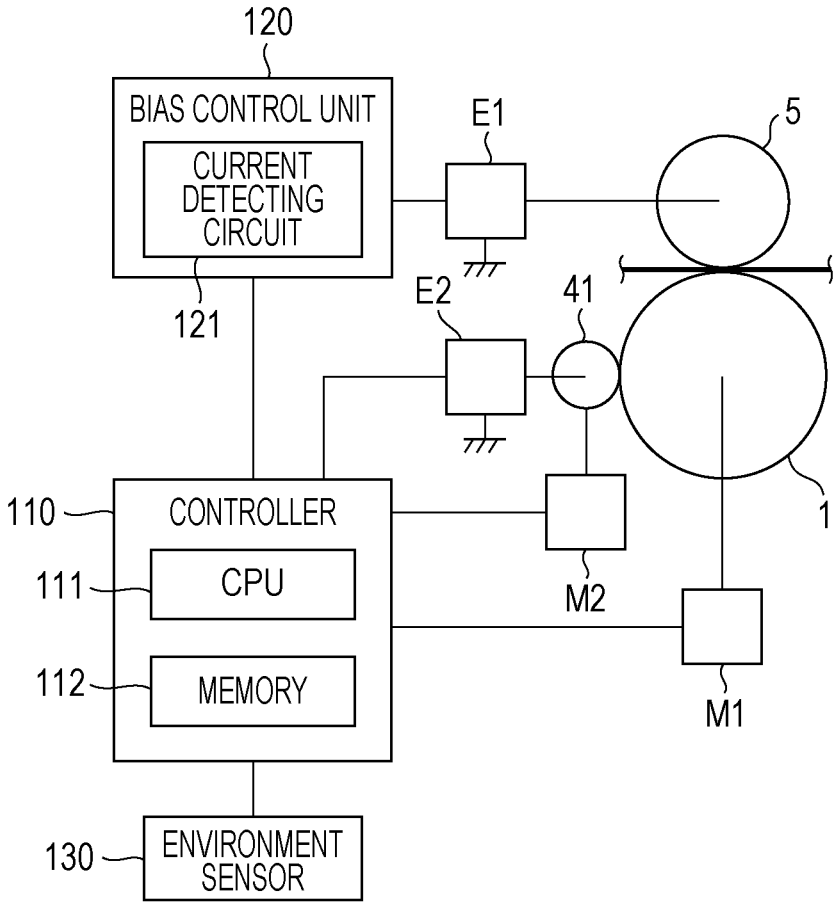
FIG. 2 is a schematic control block diagram of an essential part of an image forming apparatus.

FIG. 2 illustrates a schematic control configuration of an essential part of the image forming apparatus 100 according to this exemplary embodiment.

A controller 110 has a CPU 111 serving as a control unit centrally performing calculation processing and a memory (storage medium) 112 serving as a storage unit such as a ROM and a RAM. The RAM that is rewritable memory stores information input to the controller 110, detected information and calculation results, and the ROM stores a control program and a data table acquired in advance. The CPU 111 and the memory 112 such as the ROM and the RAM may transfer and read data to and from each other.

A primary transfer power supply (high-tension circuit) E1 is connected to the primary transfer roller 5. A bias control unit 120 is connected to the primary transfer power supply E1 and controls a bias to be applied from the primary transfer power supply E1 to the primary transfer roller 5 under control of the controller 110. The bias control unit 120 has a current detection circuit 121 serving as a detection member configured to detect a value of current fed when a predetermined voltage value bias is applied from the primary transfer power supply E1 to the primary transfer roller 5.

In order to reduce costs, the primary transfer power supply E1 according to this exemplary embodiment may not include a constant current circuit but only include a constant voltage circuit constant between the current circuit and the constant voltage circuit. Thus, according to this exemplary embodiment, a PTVC control to be performed in a constant voltage circuit, as will be described below in detail, is used as a control for determining a condition for a bias to be applied from the primary transfer power supply E1 to the primary transfer roller 5 in order to perform the primary transfer. An output value of the primary transfer power supply E1 according to this exemplary embodiment has a range of 0 to 3.5 kV. In other words, 0 to 3.5 kV is a range of the voltage value corresponding to a target current value necessary for the primary transfer determined by a PTVC control, which will be described in detail below.

The drum driving motor M1, development power supply E2, and development driving motor M2 may be connected to the controller 110. The controller 110 may control the ON/OFF states of the drum driving motor M1, the ON/OFF states of the development power supply E2 and output values therefrom and the ON/OFF state of the development driving motor M2. Thus, the controller 110 is capable of detecting the ON/OFF states of the drum driving motor M1, development power supply E2, and development driving motor M2 based on relationships with other operations.

For simplification, FIG. 2 only shows one primary transfer power supply E1, one bias control unit 120, one drum driving motor M1, one development power supply E2 and one development driving motor M2 corresponding to one image formation part S. However, according to this exemplary embodiment, at least the primary transfer power supply E1, bias control unit 120 and development power supply E2 are provided in each image formation part S.

The image forming apparatus 100 may further have an environmental sensor 130 capable of a relative humidity, a water content and a temperature. The environmental sensor 130 serves as an environment detection member configured to detect information provided in an environment placed in the main body of the image forming apparatus 100. The environmental sensor 130 is connected to the controller 110.

The controller 110 generally controls the components of the image forming apparatus 100 to cause them to perform sequence operations. The controller 110 may receive an image formation signal (image data or control instruction) from an external host apparatus (not illustrated) such as an image reading apparatus or a personal computer and, based on the signal, controls the components of the image forming apparatus 100 to cause them to execute image formation operations. According to this exemplary embodiment, the controller 110 may serve as a determination unit configured to determine a bias voltage value to be applied for transfer from the primary transfer power supply E1 to the primary transfer roller 5 based on a detection result from the current detection circuit 121. According to this exemplary embodiment, the controller 110 may further serve as an execution unit, which will be described in detail below.

3. Control Over Transfer Bias

Next, transfer bias control methods will be described. As described above, transfer bias control methods may include an ATVC control method and a PTVC control method.

According to the ATVC control (Active Transfer Voltage Control) method, a constant current corresponding to a current value necessary for transfer of a toner image in image formation processing is supplied (applied) as a target current value to a transfer portion through which a toner image or a recording medium has not passed, and the voltage value output as a result is measured. Thus, information regarding an electric resistance of the transfer member may be detected. Based on the measurement result, the voltage value to be applied to the transfer member in the image formation processing is set.

According to the PTVC control (Programmable Transfer Voltage Control) method, a plurality of grades (a plurality of levels) of constant voltage are applied to a transfer portion through which a toner image or a recording medium has not passed, and values of current fed to the transfer portion at the corresponding grades (levels) are measured. From the thus acquired voltage-current data corresponding to the plurality of grades (levels), a voltage value corresponding to current value (target current value or target transfer current value) necessary for transfer of a toner image in image formation processing is acquired by performing interpolation calculation thereon. Based on the calculation result, the constant voltage to be used for the image formation processing is set. The target current value in this case is set based on a transfer current value table preset for toner charge amounts depending on the temperature and humidity of an environment in which the image forming apparatus is provided. While detection of information regarding an electric resistance of a transfer member is executed by a constant current control according to the ATVC control, it is executed only by a constant voltage control according to the PTVC control. This may simplify the involved circuits, which may easily improve accuracy of detection.

According to this exemplary embodiment, the primary transfer power supply E1 does not include a constant current circuit for cost reduction, as described above. Accordingly, the PTVC control is used as a transfer bias control method here.

In this case, the transfer voltage value according to the PTVC control is determined at a predetermined timing during a non-image-formation period. Such a non-image-formation period may be a pre-multi-rotation period, a pre-rotation, an interval between sheets, or a post rotation period. In the pre-multi-rotation, a predetermined preparatory operation is executed when the image forming apparatus is powered on or returns from a sleep mode. The pre-rotation period corresponds to a period from input of an image formation start instruction to actual writing of an image corresponding to an image information process, and a predetermined preparatory operation is executed in the pre-rotation period. The interval between sheets corresponds to an interval from a recording medium to a recording medium in continuous image formation processes. In the post rotation, a predetermined organization operation (preparatory operation) may sometimes be executed after an image formation process ends. The predetermined timing may be a pre-rotation period for each job (a series of image formation operations on a single or a plurality of recording media in response to one image formation start instruction) or a pre-rotation period, a post rotation period or an interval between sheets after a predetermined number of image-formed sheets.

According to this exemplary embodiment, a simpler correction control is performed which corrects a transfer voltage value determined once by the PTVC control as described above, for reduction of down time and reduction of an influence on productivity. This may eliminate the necessity for an excessive down time for determination of a transfer voltage value according to a PTVC control, for example, and a proper transfer current may be acquired as a result. When the frequency of execution of the control for determining a transfer voltage value according to a PTVC control, for example, may be reduced, the frequency of execution of the correction control may be arbitrary. For example, a control for determining a transfer voltage value according to a PTVC control may be executed during a pre-rotation period for each job, and the correction control may be executed during an interval between sheets during the job. For example, a control for determining a transfer voltage according to a PTVC control may be executed during a pre-rotation period for every predetermined number of image formed sheets, and the correction control may be executed during a pre-rotation period or an interval between sheets every predetermined number of image formed sheets or for each job.

However, the correction control may sometimes cause a problem that a transfer voltage value after the correction may not be proper because a difference value of transfer current depending on the presence or absence of a developing AC bias largely varies in accordance with the amount of fogging toner under some conditions such as its environment, as described above.

Accordingly, in this exemplary embodiment, the difference value of transfer current depending on the presence or absence of a developing AC bias is changed to correct the set transfer voltage value properly in a manner which will be described in detail below.

4. Determination and Correction of Transfer Voltage Value

Next, operations for determination and correction of a transfer voltage value according to this exemplary embodiment will be described in detail. According to exemplary embodiment, those operations are substantially similarly performed on the image formation parts SY, SM, SC, and SK. Therefore, they will be described below with focus on one image formation part S.

4-1. PTVC Control

Figure 3:
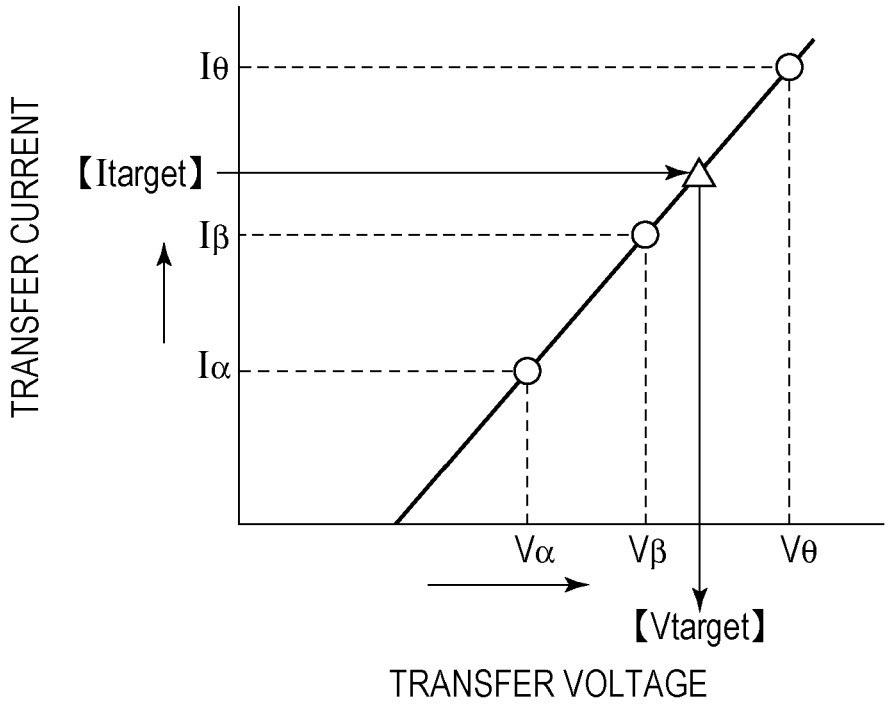
FIG. 3 is a graph for explaining a PTVC control.

First, a PTVC control according to this exemplary embodiment will be described in more detail. FIG. 3 is a schematic diagram illustrating a relationship (voltage-current characteristic) between applied voltage values and detected current values measured in the PTVC control.

During a period when a toner image is not passing through the primary transfer portion N1, a plurality of levels of voltage values Vα, Vβ, and Vθ with different potentials are applied to the primary transfer roller 5, and the current values Iα, Iβ, and Iθ fed in response thereto are detected by the current detection circuit 121. Then, from the voltage-current characteristic, a voltage value corresponding to a target current value (Itarget) necessary for the primary transfer is acquired by performing an interpolation calculation, and a transfer voltage value (Vtarget) corresponding to the target current value (Itarget) is acquired therefrom. If the calculated transfer voltage value (Vtarget) corresponding to the target current value (Itarget) according to the PTVC control exceeds an upper limit value of 3.5 kv of the output of the primary transfer power supply E1, the upper limit value, 3.5 kv, is applied as a transfer voltage value.

According to this exemplary embodiment, the controller 110 serving as the determination unit performs control over the operation for obtaining a voltage-current characteristic according to the PTVC control and calculation and determination of a transfer voltage value according to the PTVC control, as described above.

4-2. Correction Control

Figure 4:
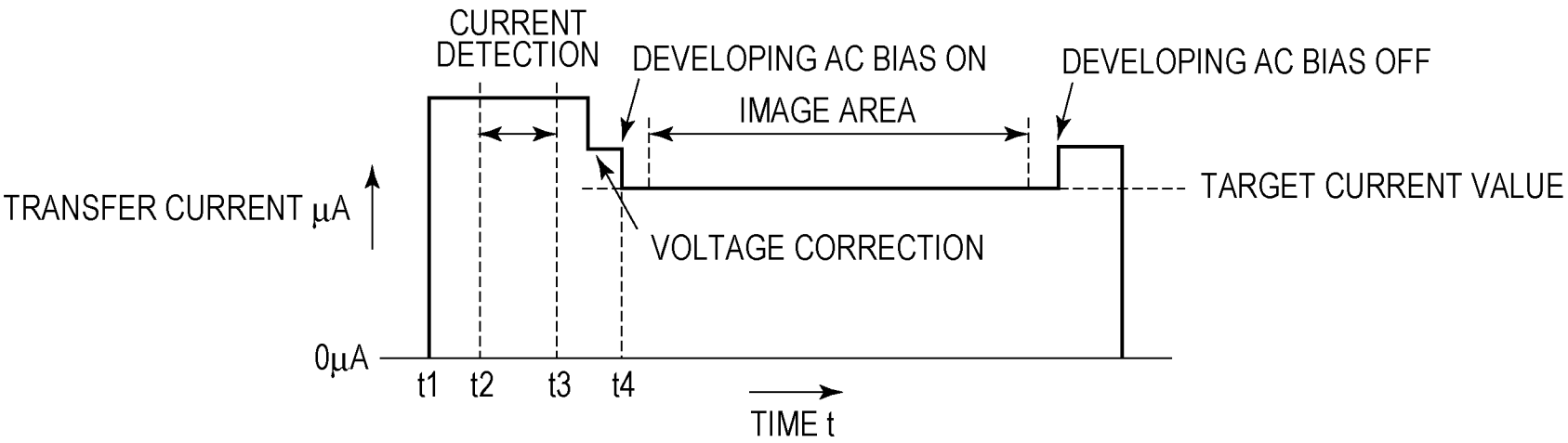
FIG. 4 is a timing chart for explaining a correction control to be performed on a transfer voltage value during a pre-rotation period.
Figure 5:
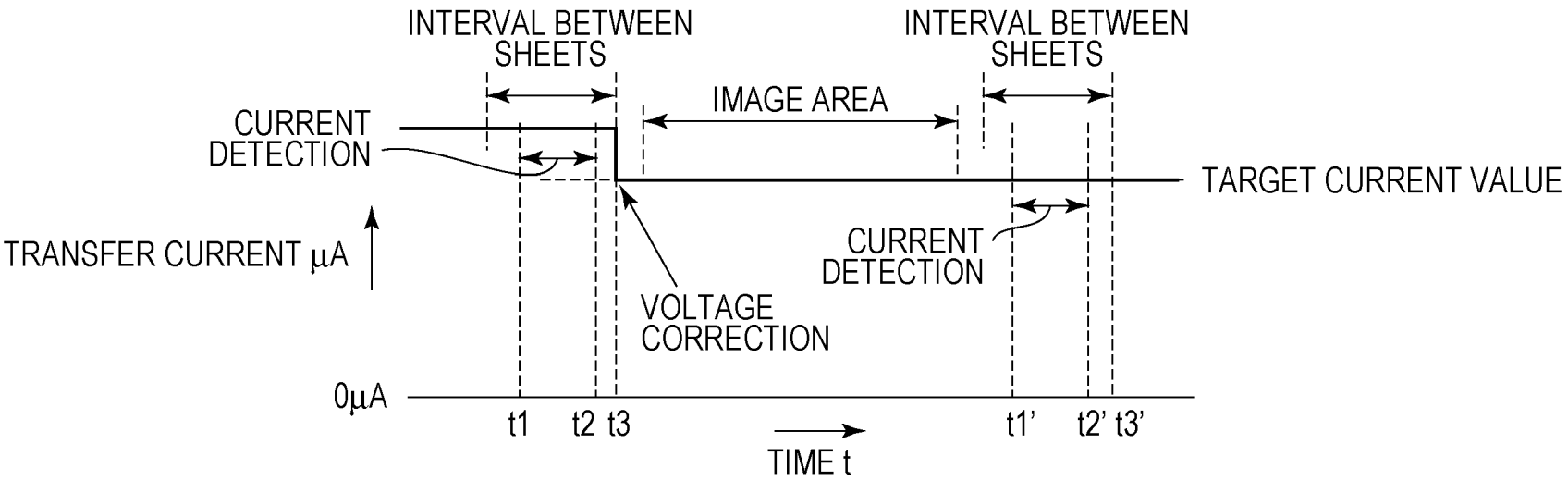
FIG. 5 is a timing chart for explaining a correction control to be performed on a transfer voltage value during an interval between sheets.

Next, a correction control to be performed on a transfer voltage value according to this exemplary embodiment will be described in more detail. FIGS. 4 and 5 are flowcharts illustrating changes of a transfer current value occurring when a correction control is performed during a (1) pre-rotation period and an (2) interval between sheets.

4-2-1. Correction Control During Pre-Rotation Period

As illustrated in FIG. 4, during a pre-rotation period, a primary transfer bias for the currently set transfer voltage value rises. It should be noted that at or before a timing t1 during a pre-rotation period, the photoconductive drum 1 is started to rotate, and application of a charge bias is started to the charging roller 2 under the same condition as that for image formation operations according to this exemplary embodiment. Here, the currently set transfer voltage value may be a value determined by the PTVC control or a value corrected by the correction control after it is determined once by the PTVC control.

Then, when the primary transfer bias rises and a stable output is acquired, the controller 110 causes the current detection circuit 121 to detect the current values for one rotation of the primary transfer roller 5 every 8 msec at a plurality of points from the timing t2 and finish the detection at the timing t3. It should be noted that the period for detecting transfer current values is not limited to one rotation of the primary transfer roller 5 but may be two or more rotations or may be a rotation less than one as required. However, in order to acquire an average value of transfer current values in the circumferential direction of the primary transfer roller 5 with high accuracy, transfer current values for a period corresponding to at least one rotation of the primary transfer roller 5 may be detected.

Normally, application of a developing AC bias is started immediately before an image area. Here, the term image area refers to a region of the photoconductive drum 1 in which a toner image may be formed in a moving direction of the surface of the photoconductive drum 1. Thus, the detection of a transfer current value ends before application of a developing AC bias is started. Therefore, a detected transfer current value (detected current value) here refers to a value detected without application of a developing AC bias thereto. According to this exemplary embodiment, the timing for switching the ON/OFF state of a developing AC bias, the timing for switching the ON/OFF state of a developing DC bias, and the timing for switching the ON/OFF state of rotational driving of the developing sleeve 41 are substantially the same. Thus, when a developing AC bias is not applied, a developing DC bias is not applied either. The rotation of the developing sleeve 41 is also stopped. On the other hand, when a developing AC bias is applied, a developing DC bias is also applied. The developing sleeve 41 is rotating.

As described above, in a state with application of a developing AC bias, the transfer current value decreases by the amount equivalent to the amount of fogging toner, as in image formation operations. The target current value required for the primary transfer is set to a value assuming the current value in a state with application of a developing AC bias in image formation operations. For that, in order to meet the condition for the image formation operations, a difference value of transfer current values in a state without application of a developing AC bias and in a state with application of it may be subtracted from a transfer current value in a state without application of the developing AC bias to compare the difference value between transfer current values based on the presence and absence of a developing AC bias with the target current value. Correction of a transfer voltage value with a voltage value corresponding to a current difference between the subtracted transfer current value and the target current value allows a target current value closer to the transfer current value. According to this exemplary embodiment, the difference value between transfer current values based on the presence and absence of a developing AC bias to be used here may be set for each environment and may be stored in the memory 112 as a table that is information describing a relationship between the difference value and environment information.

Table 1 is a table showing an experimentally acquired difference value between transfer current values based on the presence and absence of a developing AC bias set for each environment.

TABLE 1

| ENVIRONMENT NO. | 1 | 2 | 3 | 4 | 5 | 6 | 7 |
|---|---|---|---|---|---|---|---|
| RELATIVE HUMIDITY % | 5 | 15 | 25 | 35 | 50 | 65 | 80 |
| DIFFERENCE VALUE BETWEEN TRANSFER CURRENT VALUES BASED ON THE PRESENCE AND ABSENCE OF A DEVELOPING AC BIAS | 0.4 | 0.9 | 1.3 | 1.7 | 2.3 | 3 | 3.9 |

The amount of fogging toner on the photoconductive drum 1 may vary in accordance with the charge amount of toner. For example, the charge amount of toner used in this exemplary embodiment may tend to particular follow the relative humidity of an environment in which the toner is placed. Therefore, according to this exemplary embodiment, seven environment sections are defined in accordance with relative humidities, and the difference value between transfer current values based on the presence and absence of a developing AC bias is set based on the amount of fogging toner for each of the environment sections. For example, according to this exemplary embodiment, in environments having a relative humidity of 5% and a relative humidity of 80%, the difference between transfer current values based on a difference between amounts of fogging toner may be as large as 3.5 μA (=3.9 μA−0.4 μA). The environment sections are not limited to be set based on relative humidities but may be set based on arbitrary environment information sensitive to the amount of fogging toner, such as a temperature, a humidity and an absolute water content.

The controller 110 causes the environmental sensor 130 to detect an environment for detection of a transfer current value in a correction control and reads out the difference value between transfer current values based on the presence and absence of a developing AC bias from the table illustrated in Table 1 based on the relative humidity related to the detection result. The difference value between transfer current values based on the presence and absence of a developing AC bias is read out in accordance with the corresponding relative humidity acquired by performing linear interpolation on the relative humidities in the environment sections 1 to 7 in the table illustrated in Table 1. In other words, the controller 110 changes the difference value to be used for adjustment of the detected current value in accordance with relative humidity information serving as environment information.

Next, the controller 110 subtracts the difference value between transfer current values based on the presence and absence of a developing AC bias acquired based on the table as described above from the detected current value. In other words, the controller 110 adjusts the detected current value by using the difference value changed in accordance with relative humidity information serving as environment information. The controller 110 holds in the memory 112 the transfer current value after the subtraction. In a case where the current values at a plurality of points are detected as in this exemplary embodiment, the difference value is subtracted in accordance with the environment used for acquiring the detected current value from the detected current value at the points. Alternatively, in a case where environments used for acquiring the detected current values at a plurality of points may be regarded as the substantially same, as in a case where current values are detected substantially serially at a plurality of points during a pre-rotation period, the difference value in accordance with the environment may be subtracted from an average value of the detected current values at the points. Then, the thus acquired average value of the current values is held in the memory 112 (such an average value may be called a value acquired by subtracting a difference value from a detected current value).

Next, the controller 110 compares the transfer current value acquired by subtracting the difference value between transfer current values based on the presence and absence of a developing AC bias from the detected current value with the target current value. The controller 110 calculates a current difference between the transfer current value after the subtraction and the target current value in order to bring the transfer current value after the subtraction close to the target current value. The controller 110 calculates a voltage value (correction voltage value) corresponding to the current difference from a plurality of levels of voltage-current data acquired by the PTVC control. In this case, the correction voltage value corresponding to the current difference may be calculated from a linear slope of the plurality of levels of voltage-current data acquired by the PTVC control as illustrated in FIG. 3. The controller 110 adds or subtracts the correction voltage value acquired as described above to or from the transfer voltage value with the currently set (or applied) primary transfer bias and determines the transfer voltage value to be applied for image formation processing.

After that, the controller 110 switches the transfer voltage value after the primary transfer bias is corrected at least until a timing t4 (80 msec from t1) before the image area reaches the primary transfer portion N1 because a time is required for switching the output value of the primary transfer power supply E1. This allows correction of the transfer voltage value such that the transfer current value for the subsequent image formation process may be equal to the target current value.

4-2-2. Correction Control in Interval Between Sheets

As illustrated in FIG. 5, during an interval between sheets, the controller 110 causes the current detection circuit 121 to detect a current value for one rotation of the primary transfer roller 5 every 8 msec at a plurality of points from the timing t1 to the timing t2.

As described above, a developing AC bias may be turned off also during an interval between sheets and be turned on immediately before a next image area in order to prevent deterioration of the developer. However, an interval between sheets (or the time period corresponding thereto) is normally short. Thus, the time for switching the ON/OFF state of a developing AC bias may not be provided, and a developing AC bias keeping the same value as that for the previous image formation is continuously applied even during an interval between sheets. Normally, the time for switching the ON/OFF state of the primary transfer bias may not be provided, a primary transfer bias keeping the same value as that for the previous image formation is continuously applied even during an interval between sheets. In this case, the rotational driving of the photoconductive drum 1 and the application of a charge bias to the charging roller 2 are continuously performed under the same condition as that for the previous image formation.

Thus, the transfer current value (detected current value) detected during an interval between sheets is a value detected at a state with application of a developing AC bias. Therefore, like a detected current value at a state without application of a developing AC bias during a pre-rotation period as described above, the difference value between transfer current values based on the presence and absence of a developing AC bias set for each environment is not required to be subtracted.

In other words, the controller 110 holds the detected current value in the memory 112. In a case where current values are detected at a plurality of points, as in this exemplary embodiment, the average value of the detected current value at the points is held in the memory 112 (such an average value may sometimes be called a detected current value). In a case where an interval between sheets is short and the current value for one rotation of the primary transfer roller 5 may not be detected during one interval between sheets, current values may be detected during a plurality of intervals between sheets, and the current values may be averaged.

Next, the controller 110 compares the detected current value and a target current value. In order to acquire a close detected current value to the target current value, the controller 110 calculates a current difference between the detected current value and the target current value. The controller 110 calculates the correction voltage value corresponding to the current difference from a plurality of levels of voltage-current data acquired by the PTVC control, in the same manner for the correction control during a pre-rotation period as described above. The controller 110 adds or subtracts the correction voltage value acquired as described above to or from the transfer voltage value with the currently set (or applied) primary transfer bias and determines the transfer voltage value to be applied for image formation processing.

After that, the controller 110 switches the transfer voltage value after the primary transfer bias is corrected at least until a timing t3 (80 msec from the start of the interval between sheets) before the image area reaches the primary transfer portion N1. This allows correction of the transfer voltage value such that the transfer current value for the subsequent image formation process may be equal to the target current value. The same is true for t1', t2' and t3' in the next interval between sheets.

4-2-3. Specific Examples

Figure 6:
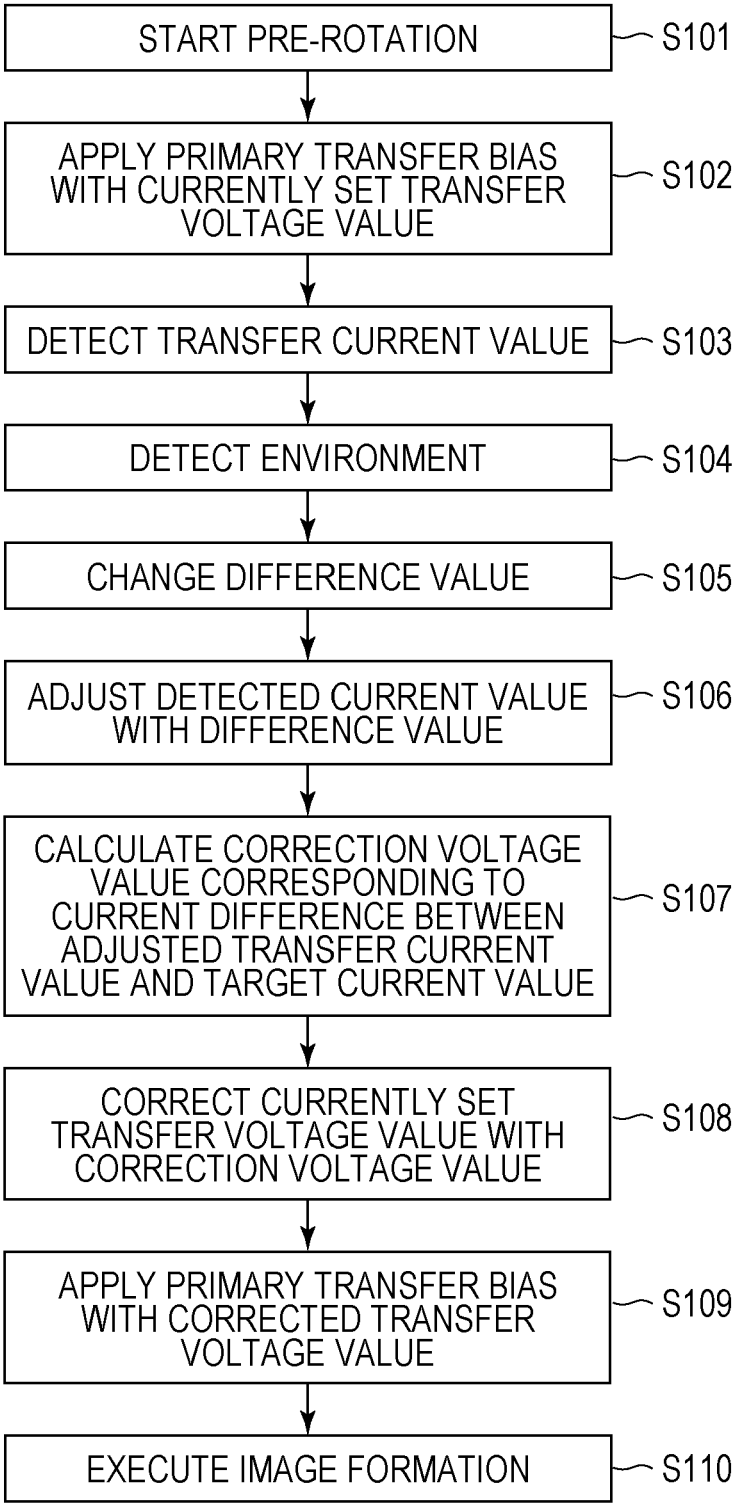
FIG. 6 is a flowchart illustrating an example of a procedure of a correction control on a transfer voltage value.

Specific examples of the correction control during a pre-rotation period will be described with reference to FIG. 6.

First, after execution of image formation operations are instructed, a pre-rotation is performed (S101). The photoconductive drum 1 is electrostatically charged, and a predetermined primary transfer bias determined by a PTVC control is applied (S102). A transfer current value is detected during a time period for one rotation of the primary transfer roller 5 (S103). A relative humidity for the detection of the transfer current value is also detected (S104). A difference value in accordance with the relative humidity for the detection of the transfer current value is selected from the table illustrated in Table 1 (that is, a difference value to be used for adjustment of the detected current value is changed in accordance with the relative humidity) (S105). Here, it is assumed that the relative humidity detected by the environmental sensor 130 is 65%, and the target current value for the primary transfer with the humidity is 40 μA. The detected current value in the correction control during the pre-rotation period is the current value at a state without application of a developing AC bias. Thus, 3 μA that is difference value between transfer current values based on the presence and absence of a developing AC bias when the relative humidity is 65% is subtracted from 45 μA that is an average value of the detected current values acquired in this case (that is, the detected current value is adjusted with the difference value) (S106). The value 42 μA acquired by subtracting the difference value between transfer current values based on the presence and absence of a developing AC bias from the detected current value in that manner is equal to the transfer current value in a state with application of the developing AC bias, that is, in the same state as that during the image formation processing.

As described above, because the target current value is equal to 40 μA, the transfer current value 42 μA after the subtraction of the difference value is larger than the target current value by Δ+2 μA. In order to correct the current value Δ+2 μA, the correction voltage value corresponding to Δ+2 μA is calculated from a plurality of levels of voltage-current data acquired by the PTVC control (S107). The thus calculated correction voltage value is subtracted from the currently set transfer voltage value, and the result is handled as the corrected transfer voltage value (S108). Then, application of the primary transfer bias with the corrected transfer voltage value is started before the subsequent image area reaches the primary transfer portion N1 (S109). After that, the pre-rotation ends, and the image formation is started (S110).

This control allows correction of a difference between the detected current value during a correction control and a target current value for actual image formation processing in a state with application of a developing AC bias.

4-2-4. Variation Examples

In the description above, a transfer current value during a pre-rotation period is detected without application of a developing AC bias, and a transfer current value during an interval between sheets is detected with application of a developing AC bias. However, when transfer current values are detected at a plurality of points of one rotation of the primary transfer roller 5, for example, the detected current values at some of the points may be acquired without application of a developing AC bias while the detected current values at the other points may be acquired with application of the developing AC bias.

In other words, the driving of the sleeve and the application of a developing AC bias are started immediately before an image area to suppress deterioration of the developer. Thus, during a pre-rotation period, a transfer current value may normally be detected without application of a developing AC bias. However, during a pre-rotation period, a case may possibly occur in which the driving of the sleeve and the application of a developing AC bias are executed at a timing when a transfer current value is detected because of connections with other adjusting operations. On the other hand, because the time for a normal interval between sheets is short and no time is required for driving and high-voltage switching, the sleeve is being driven and a developing AC bias is being applied continuously. However, when an interval between sheets is longer than a predetermined period of time, the driving of the sleeve and the application of a developing AC bias are may sometimes be stopped to suppress the developer deterioration. Having described the case where transfer current values for one rotation of the primary transfer roller 5 are detected over a plurality of intervals between sheets, transfer current values for one rotation of the primary transfer roller 5 may be detected during a pre-rotation period and an interval between sheets. There may be a case where a developing AC bias is applied and a case where it is not applied at a timing when a transfer current value is detected during a pre-rotation period, an interval between sheets or both. More specifically, such cases may occur when a down time occurs due to a small-sized paper fed or when an image adjustment operation occurs during an image process.

Figure 7:
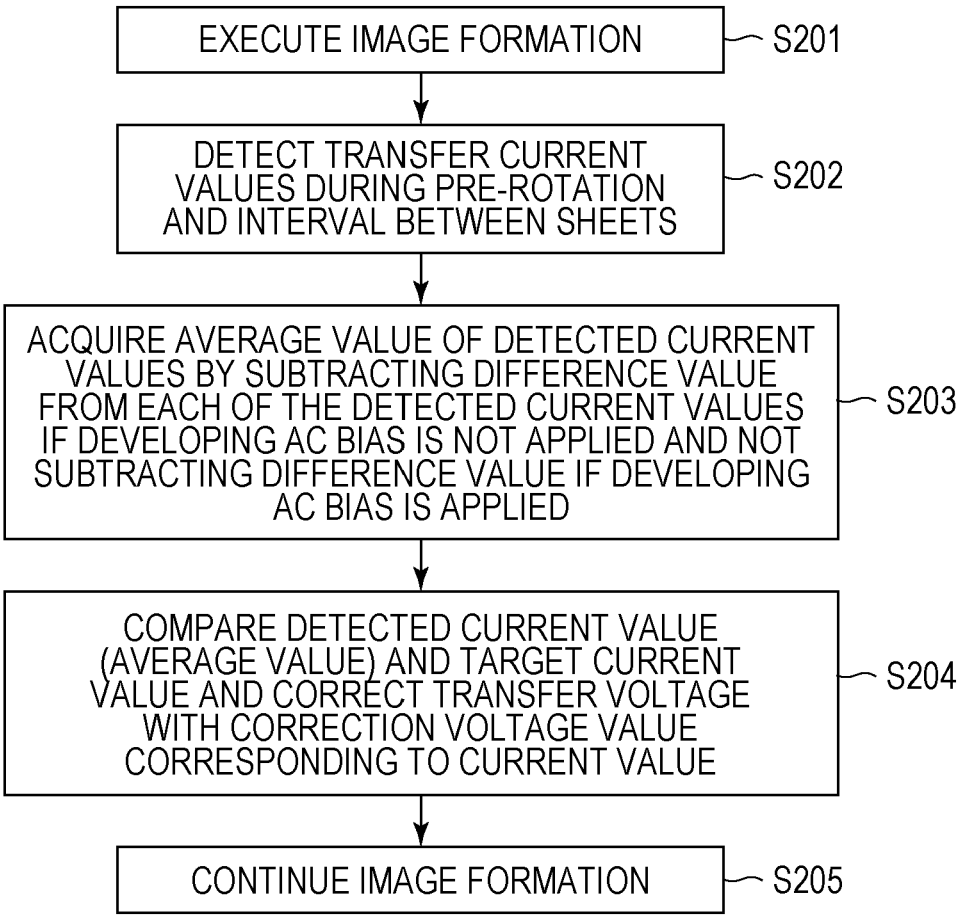
FIG. 7 is a flowchart illustrating another example of the procedure of the correction control on a transfer voltage value.

In such cases, calculations related to the correction control may be performed. FIG. 7 illustrates a flow of control in a case where transfer current values are to be detected during a pre-rotation period and an interval between sheets in a state without application of a developing AC bias and a state with application of a developing AC bias are both present, for example. When execution of image formation processing is instructed (S201), transfer current values are detected both during a pre-rotation period and during an interval between sheets (S202). Next, the controller 110 judges whether the detected current values at a plurality of points are individually acquired in a state with application of a developing AC bias or not. This allows distinction between a point for which a difference value between transfer current values based on the presence and absence of a developing AC bias should be subtracted (or a detected current value acquired in a state without application of a developing AC bias) and a point for which the subtraction is not necessary (or a detected current value acquired in a state with application of a developing AC bias). Then, an average value of the detected current values at the points are acquired by subtracting such a difference value for the point requiring the subtraction and not performing the subtraction for the point not requiring it (S203). The difference value in this case varies in accordance with the environment under which the detected current values are acquired in the same manner as described above. After that, the transfer voltage value is corrected (S204), and the image formation processing continues (S205), in the same manner as described above.

As described above, according to this exemplary embodiment, the controller 110 may function as the correction unit configured to correct the transfer voltage value based on the difference between a detected current value acquired by the current detection circuit 121 when the currently set transfer voltage value is applied while image formation processing is not performed and a target current value. Further, according to this exemplary embodiment, the controller 110 may function as an adjusting unit configured to adjust the detected current value based on a difference value between current values detected by the current detection circuit 121 due to a difference between a condition under which the detected current value is acquired and a predetermined condition for image formation processing. Still further, according to this exemplary embodiment, the controller 110 may function as a changing unit configured to change the difference value to be used for the adjustment of detected current values.

Particularly, according to this exemplary embodiment, the difference in condition may be caused by the presence and absence of application of an AC bias to the developing device 4 when the surface of the photoconductive drum 1 being in the primary transfer portion N1 for detection of transfer current values is in the developing portion G. According to this exemplary embodiment, the detected current values without application of the AC bias are adjusted in accordance with the difference value based on the presence and absence of application of the AC bias (by subtracting the difference value). However, an embodiment of the present invention is not limited thereto. The difference in condition may be caused by the presence and absence of a rotation of the developing sleeve 41 included in the developing device 4 when the surface of the photoconductive drum 1 being in the primary transfer portion N1 for detection of transfer current values is in the developing portion G. In this case, the detected current value acquired when the developing sleeve 41 does not rotate is adjusted in accordance with the difference value based on the presence and absence of rotation of the developing sleeve 41 (by subtracting the difference value). When an application of a developing AC bias and rotational driving of the developing sleeve 41 are in synchronization, either condition may be used. However, the condition based on the presence or absence of application of a developing AC bias may be used which is directly related to the adherence of fogging toner. According to this exemplary embodiment, the difference value to be used for the adjustment of detected current values may be changed in accordance with information in mutual relation with the amount of toner (fogging toner) adhered to a non-image part of the photoconductive drum 1. Typically, it may be configured such that the difference value increases as the amount of fogging toner described in the information increases. Particularly, as in this exemplary embodiment, the information may be environment information. Typically, it may be configured such that the difference value increases as the relative humidity described in the information increases.

As described above, according to this exemplary embodiment, the difference value between transfer current values based on the presence and absence of a developing AC bias to be used for a correction control may be changed in accordance with environment information that has an influence on the amount of fogging toner. This may suppress occurrence of an influence of a difference in transfer current value based on the amount of fogging toner dependent on its environment. Thus, a transfer voltage value may be corrected so as to acquire a transfer current value close to a target current value with high accuracy, which contributes to suppression of occurrence of a defect image due to a defective transfer. In other words, according to this exemplary embodiment, the correction control which corrects a preset transfer voltage value is executed so that reduction of a down time may be attempted with improved accuracy of the correction control.

Second Exemplary Embodiment

Next, a second exemplary embodiment of the present invention will be described. The fundamental constitutions and operations of an image forming apparatus of this exemplary embodiment are similar to those of the first exemplary embodiment. Therefore, identical numbers refer to parts having identical or corresponding functions and constitutions to those in the image forming apparatus of the first exemplary embodiment.

According to the first exemplary embodiment, the difference value between transfer current values based on the presence and absence of a developing AC bias is changed in accordance with its environment (particularly, relative humidity). According to this exemplary embodiment, on the other hand, the difference value between transfer current values based on the presence and absence of a developing AC bias is changed in accordance with use history information (history information regarding operating conditions in repeated image formation processing) in addition to its environment. Particularly, according to this exemplary embodiment, use history information on a developer may be used as the use history information.

The amount of fogging toner generally increases as the number of repetitions of image formation processing using a developer increases. Such an increase of the amount of fogging toner may generally vary in accordance with a relative humidity. Accordingly, in this exemplary embodiment, information usable for correcting the difference value preset in accordance with an environment based on a change of the amount of fogging toner acquired from the use history of a developer is stored as a table in the memory 112. This allows more accurate correction controls.

The difference value between transfer voltage values based on the presence and absence of a developing AC bias may be changed only based on a use history such as a use history of a developer. The use history is not limited to a use history of a developer but may be arbitrary use history information generally sensitive to the amount of fogging toner including information mutually related to a use history of a developer, such as use history information on a photosensitive member or a process cartridge.

Figure 8:
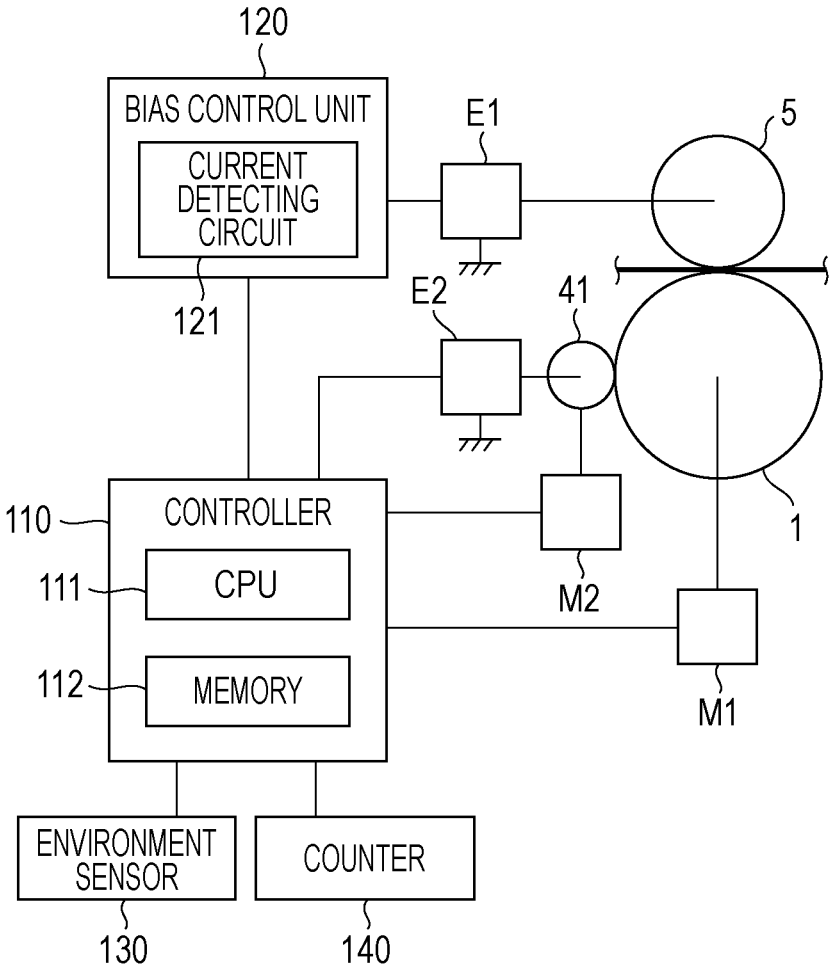
FIG. 8 is a schematic control block diagram illustrating an essential part of another example of the image forming apparatus.
Figure 9:
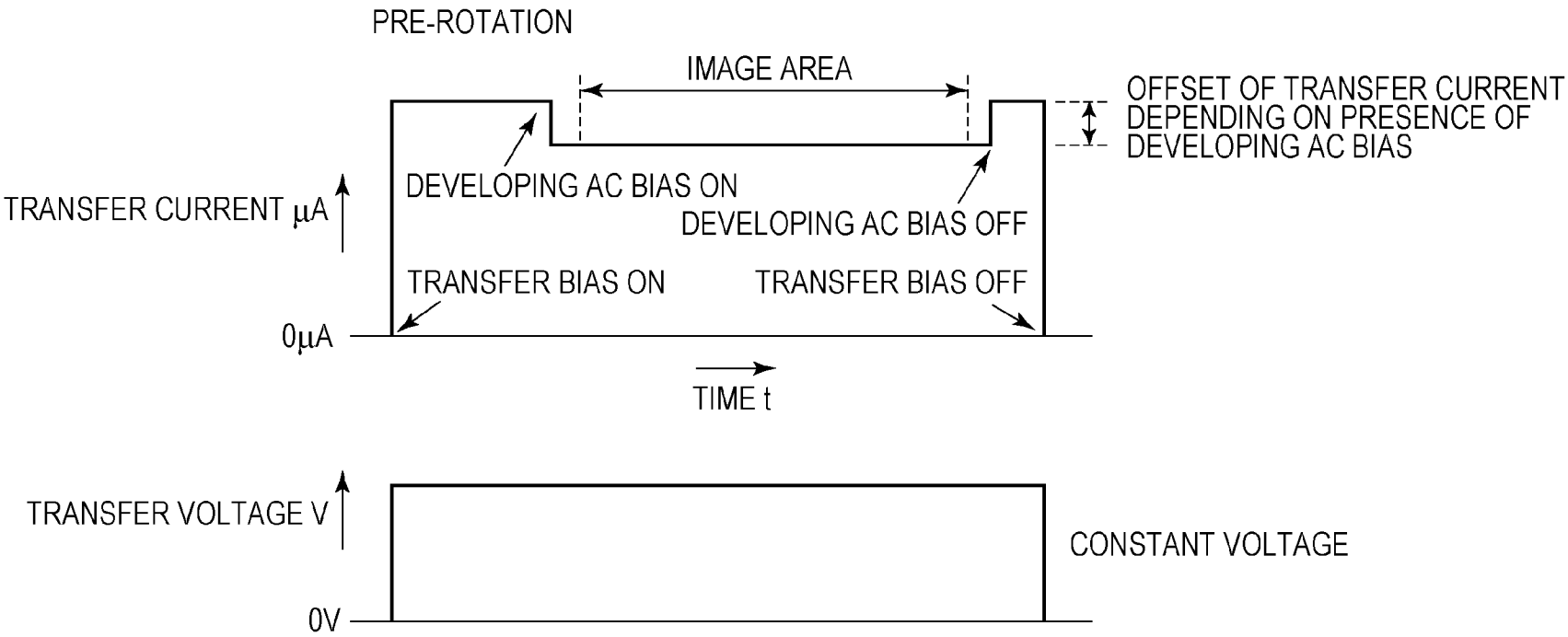
FIG. 9 is a timing chart for explaining a difference value of a transfer current detected due to a difference in condition.

FIG. 8 illustrates a schematic control configuration of an essential part of an image forming apparatus 100 according to this exemplary embodiment. The image forming apparatus 100 of this exemplary embodiment has a counter 140 serving as a history detection member and including a storage device usable for detecting a use history of a developer. The counter 140. As the use history information on a developer, the number of sheets having undergone image formation processing using the process cartridge 12 is counted because it is correlated with a use history of the developer.

Table 2 is a table illustrating experimentally acquired rates (correction values) to be multiplied with a difference value between transfer current values based on a change of the amount of fogging toner due to repetition of image formation processing. In Table 2, the rates are ration of the amount of fogging toner increased due to repetition of image formation processing where the amount of fogging toner with the relative humidities of an initially used developer is equal to 1.

TABLE 2

| ENVIRONMENT NO. | 1 | 2 | 3 | 4 | 5 | 6 | 7 |
|---|---|---|---|---|---|---|---|
| RELATIVE HUMIDITY % | 5 | 15 | 25 | 35 | 50 | 65 | 80 |
| RATE (MAGNIFICATION) OF CHANGE OF DIFFERENCE VALUE OF TRANSFER CURRENT AFTER 30K IMAGE FORMED SHEETS FROM BEGINNING | 1.20 | 1.21 | 1.22 | 1.23 | 1.25 | 1.30 | 1.38 |

According to this exemplary embodiment, the life of the process cartridge 12 for each of colors including a developer is set to 30 k sheets. The amount of fogging toner increases at a rate as illustrated in Table 2 due to repetition of image formation processing from the beginning of use of the developer. Table 2 illustrates rates of the amount of fogging toner used for image formation processing of 30 k sheets where the initial amount of fogging toner is 1. However, the amount of fogging toner used from the beginning of use to 30 k sheets may be acquired by performing a linear interpolation thereon.

According to this exemplary embodiment, the controller 110 causes the environmental sensor 130 to detect an environment for detection of a transfer current value in a correction control and read outs the difference value between transfer voltage values based on the presence and absence of a developing AC bias from the table illustrated in Table 1 in accordance with the corresponding relative humidity, like the first exemplary embodiment. Further in this case, according to this exemplary embodiment, use history information on the developer is read from the counter 140, and a correction value based on the number of image formed sheets is read out from the table illustrated in Table 2 in accordance with the use history information and the relative humidity. The controller 110 multiplies the difference value read out from the table illustrated in Table 1 by the correction value read out from the table illustrated in Table 2. The thus corrected difference value may be used to correct the transfer voltage value, like the difference value according to the first exemplary embodiment. Thus, the transfer voltage value in an image formation process may be calculated in accordance with the difference between amounts of fogging toner which depend on the environment where the image forming apparatus 100 is placed and the use history of the used developer.

Such a difference value is not required to be subtracted from the voltage value detected in a state with application of a developing AC bias, as described in the first exemplary embodiment.

As described above, the information correlated with the amount of fogging toner may be information correlated with the use history of a developer at least including toner in the developing device 4. Typically, the difference value to be used for adjustment of a detected current value increases as the amount of usage of the developer described in the information increases.

According to this exemplary embodiment, the difference value between transfer current values based on the presence and absence of a developing AC bias to be used for a correction control is changed in accordance with environment information and use history information having influences on the amount of fogging toner. This allows suppression of influences of a difference between transfer current values based on the amount of fogging toner depending on its environment and use history. Therefore, the transfer voltage value may be corrected so as to acquire a transfer current value close to a target current value with higher accuracy, which contributes to suppression of occurrence of a defect image due to a defective transfer.

Others

Having described the present invent with reference to specific exemplary embodiments, the present invention is not limited to the aforementioned exemplary embodiments.

For example, according to the aforementioned exemplary embodiments, a PTVC control is used to determine a transfer voltage value. However, the present invention is not limited thereto, but the present invention is also applicable to a case where a transfer power supply including a constant current circuit may be used to determine a transfer voltage by performing an ATVC control as described above. It should be noted that the such a constant current circuit may include one having a constant voltage output unit and a current detection unit and detecting a current value occurring when he constant voltage output unit outputs a constant voltage and controlling a constant voltage output by the constant voltage output unit such that the detected current value may be equal to a target current value. In order to determine a transfer voltage value, information regarding an electric resistance of a transfer portion may be acquired. Thus, a transfer voltage value may be determined by detecting either of a current value occurring while the transfer power supply is outputting voltage under a constant voltage control and a voltage value occurring while a voltage under a constant current control is being output.

Having described that, according to the aforementioned exemplary embodiment, the image forming apparatus is of a tandem type applying an intermediate transfer system, the present invention is not limited thereto. The present invention is equally applicable to a tandem type/1-drum type and an intermediate transfer type/direct transfer type. A 1-drum type image forming apparatus has a plurality of developing units for one image-bearing member and transfers a plurality of toner images formed on the image-bearing member to a member to be transferred sequentially overlappingly to form an image. A direct transfer type image forming apparatus may have a recording medium carrier configured to bear and convey a recording medium serving as a member to be transferred instead of the intermediate transfer member and directly transfers a toner image from the image-bearing member to the recording medium on the recording medium carrier. In a case where a plurality of image forming parts are provided, the number of image forming parts is not limited to the number described according to the exemplary embodiment. The image forming apparatus is not limited to a color image forming apparatus but may be one having a single image forming part such as a monochrome image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-169746, filed Aug. 19, 2013, which is hereby incorporated by reference herein in its entirety.

What is claimed is:

1. An image forming apparatus comprising:

a movable image-bearing member;

an electrostatic image forming unit configured to form an electrostatic image on the image-bearing member;

a developing unit configured to develop an electrostatic image formed on the image-bearing member into a toner image in a developing portion;

a developing bias power supply configured to apply a developing bias to the developing unit;

a transfer member configured to transfer the toner image from the image-bearing member onto a member to be transferred in a transfer portion;

a transfer power supply configured to apply voltage to the transfer member;

a first detection member configured to detect a current to the transfer member;

a second detection member configured to detect an environment relating to a temperature and a humidity around the image forming apparatus;

an execution unit configured to execute a setting mode to be executed during a non-image-formation period, the setting mode setting a voltage to be applied to the transfer member during an image formation operation based on a voltage to be applied to the transfer member and a detection result from the first detection member, and a correction mode to be executed in a non-image-formation period excluding a period for executing the setting mode, the correction mode correcting the voltage set by the setting mode based on a difference between a detection result from the first detection member regarding a test voltage applied to the transfer member and a predetermined target current value, wherein a period for executing the correction mode is shorter than a period for executing the setting mode, and wherein the correction mode is executed in one of a first period when a region of the image-bearing member having been in the developing portion when the developing bias power supply has an off state passes through the transfer portion next and a second period when the region of the image-bearing member having been in the developing portion when the developing bias power supply has an on state passes through the transfer portion; and a storage unit configured to store in advance a correction current difference based on the environment that is a difference between a current when a predetermined voltage is applied to the transfer member during the first period and a current when a predetermined voltage is applied to the transfer member during the second period, wherein the execution unit corrects the voltage set by the setting mode in accordance with the correction current difference based on a detection result from the first detection member and a detection result from the second detection member in a case that the correction mode is executed during the first period.

2. The image forming apparatus according to claim 1, wherein the execution unit corrects the voltage set by the setting mode based on a detection result from the first detection member in a case that the correction mode is executed during the second period.

3. The image forming apparatus according to claim 1, wherein the storage unit further stores a target current value in accordance with the environment.

4. The image forming apparatus according to claim 1, wherein the execution unit sets a voltage to be applied to the transfer member based on detection results detected by the first detection member when a plurality of voltages are applied to the transfer member.

5. The image forming apparatus according to claim 1, wherein the test voltage in the correction mode is based on the voltage set by the setting mode.

6. The image forming apparatus according to claim 1, wherein the developing bias contains an AC component, and the AC component of the developing bias has an off state during the first period.

7. The image forming apparatus according to claim 6, further comprising:

a developing sleeve in the developing unit; and a switching unit in a main body of the image forming apparatus, the switching unit being configured to switch the developing sleeve between a rotating state and a stop state, the switching unit changing the developing sleeve to the stop state during the first period.

8. The image forming apparatus according to claim 1, wherein the execution unit sets the correction current difference so that the correction current difference when a relative humidity in the environment is a first relative humidity is larger than the correction current difference when the relative humidity is a second relative humidity that is lower than the first relative humidity.

9. The image forming apparatus according to claim 1, wherein the execution unit sets the correction current difference so that the correction current difference when the amount of developer usage is a first amount is larger than the correction current difference when the amount of developer usage is a second amount that is less than the first amount.

10. The image forming apparatus according to claim 1, wherein the developing unit includes a two-component developer containing toner and carrier.

* * * * *